US005567186A

United States Patent [19]

Diniz et al.

[11] Patent Number: 5,567,186

[45] Date of Patent: Oct. 22, 1996

[54] ELECTRICAL CABLE CONNECTOR

[75] Inventors: Milton E. Diniz, Braganca Paulista; Alexandre M. Soriano, Pedra Bela, both of Brazil

[73] Assignee: The Whitaker Corporation, Wimington, Del.

[21] Appl. No.: 332,683

[22] Filed: Nov. 1, 1994

[30] Foreign Application Priority Data

Nov. 16, 1993 [BR] Brazil ..... 7302209-8 U
Nov. 22, 1993 [BR] Brazil ..... 7302224-1 U

[51] Int. Cl.[6] ..... H01R 4/50
[52] U.S. Cl. ..... 439/783
[58] Field of Search ..... 439/783, 434, 439/435, 491

[56] References Cited

U.S. PATENT DOCUMENTS

| | | | |
|---|---|---|---|
| 3,065,452 | 11/1962 | Osborn . | |
| 3,588,791 | 6/1971 | Polidori . | |
| 3,897,992 | 8/1975 | Weidler . | |
| 4,070,082 | 1/1978 | Werner | 439/783 X |
| 4,533,205 | 8/1985 | Frank . | |
| 4,600,264 | 7/1986 | Counsel . | |
| 4,650,273 | 3/1987 | Roosdrop | 439/783 OR |
| 5,006,081 | 4/1991 | Counsel et al. | 439/783 |
| 5,187,887 | 2/1993 | Mor et al. | 439/491 X |
| 5,244,422 | 9/1993 | Laricchia | 439/783 OR |
| 5,340,336 | 8/1994 | Menechella | 439/783 OR |

FOREIGN PATENT DOCUMENTS

| | | |
|---|---|---|
| 1105730 | 12/1955 | France . |
| 1490754 | 6/1969 | Germany . |
| 754493 | 8/1956 | United Kingdom . |
| 1055135 | 1/1967 | United Kingdom . |

*Primary Examiner*—P. Austin Bradley
*Assistant Examiner*—Daniel Wittels
*Attorney, Agent, or Firm*—Timothy J. Aberle

[57] ABSTRACT

An electrical connector (1') having a generally C-shaped member (2') for electrically connecting wires (30') with a wedge member (12'). The C-shaped member (2') comprises radially arranged recesses (7') and holding teeth (10') which are adapted to provide tensile strength to the wedge member (12') for retaining the wires (30'). Indicia marks (A,B) are provided for correct sizing of the connector relative to the wires (30'). FIG. 6.

7 Claims, 4 Drawing Sheets

ELECTRICAL CABLE CONNECTOR

The present invention relates to a wedge type connector for conductor cables of electrical distribution networks, suitable for housing conductor cables of different sizes, which are placed and secured between a first, generally C-shaped outer member having teeth and a second wedge type inner member.

BACKGROUND OF THE INVENTION

An example of a known connector is shown in Brazilian Patent Application PI 9102719, wherein teeth are provided to penetrate through the cables, thus increasing the tensile value of the conductor cables of the connection.

A further known connector is disclosed in Brazilian Patent Application PI 8202511, which is a connector provided with bumpers and a latch to prevent shifting of the constituent parts of the connector.

Among the existing problems of known wedge type connectors lies the difficulty for the installer to judge beforehand the size of the connector which should be used to electrically connect conductors of several different diameters.

Considering the fact that this is a very common problem in view of the various kinds of wedge type connectors, as well as the numerous specific combinations possible for the assembly of the connectors, which are limited by the diameter of the main and by-pass conductor cables. The present invention has a purpose of providing a better utilization for the wedge type connectors by introducing a connector identification concept that may be applied to new or used connectors, both in the C-shaped outer member and in the second wedge type inner member.

SUMMARY OF THE INVENTION

The problems of the known connectors are overcome by providing an electrical cable connector which has a first C-shaped element and a second wedge shaped element, each capable of retaining electric cables, the first and second elements being secured by folding flexible sheet metal. The first C-shaped element has beaded flanges at its loose ends, and, on the bottom part, an orifice suitable for fitting a ridge provided on the rear part of the second wedge type element, characterized by the fact that at least two marks are foreseen in at least one of the components.

An additional purpose of the present invention is to provide teeth arranged in the C-Shaped member, in a place where it is permitted that the teeth be spaced apart along the length of the C-shaped member, thus permitting an increase of the tensile strength of the connecting cables.

BRIEF DESCRIPTION OF THE DRAWINGS

The present invention will now be described with the reference to the accompanying drawings, in which.

DETAILED DESCRIPTION

Figure 1:
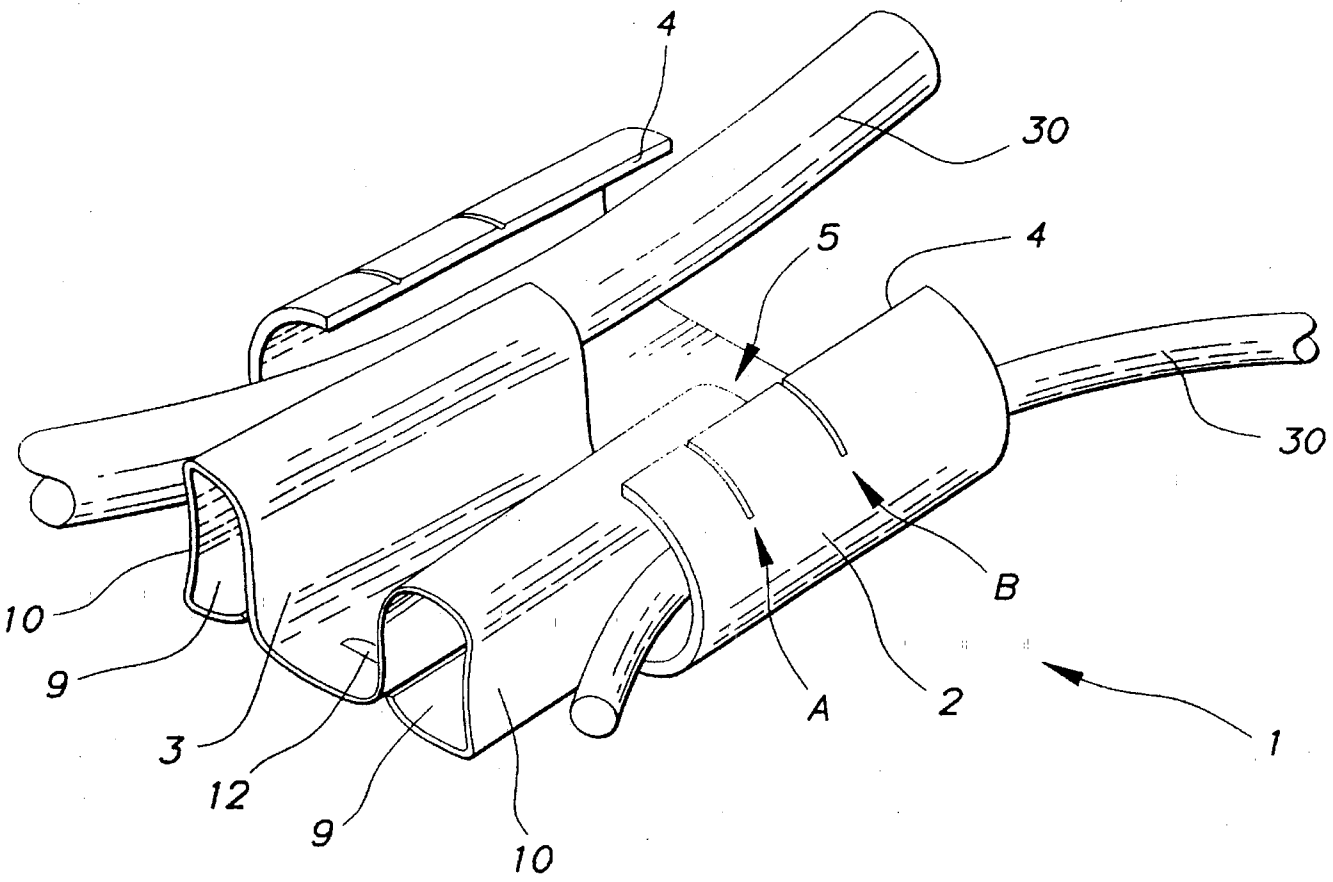
FIG. 1 is a perspective view of the top part of the connector assembly showing the first C-shaped element, the electric cable and the second wedge type element being wedged in to form the connector assembly.
Figure 2:
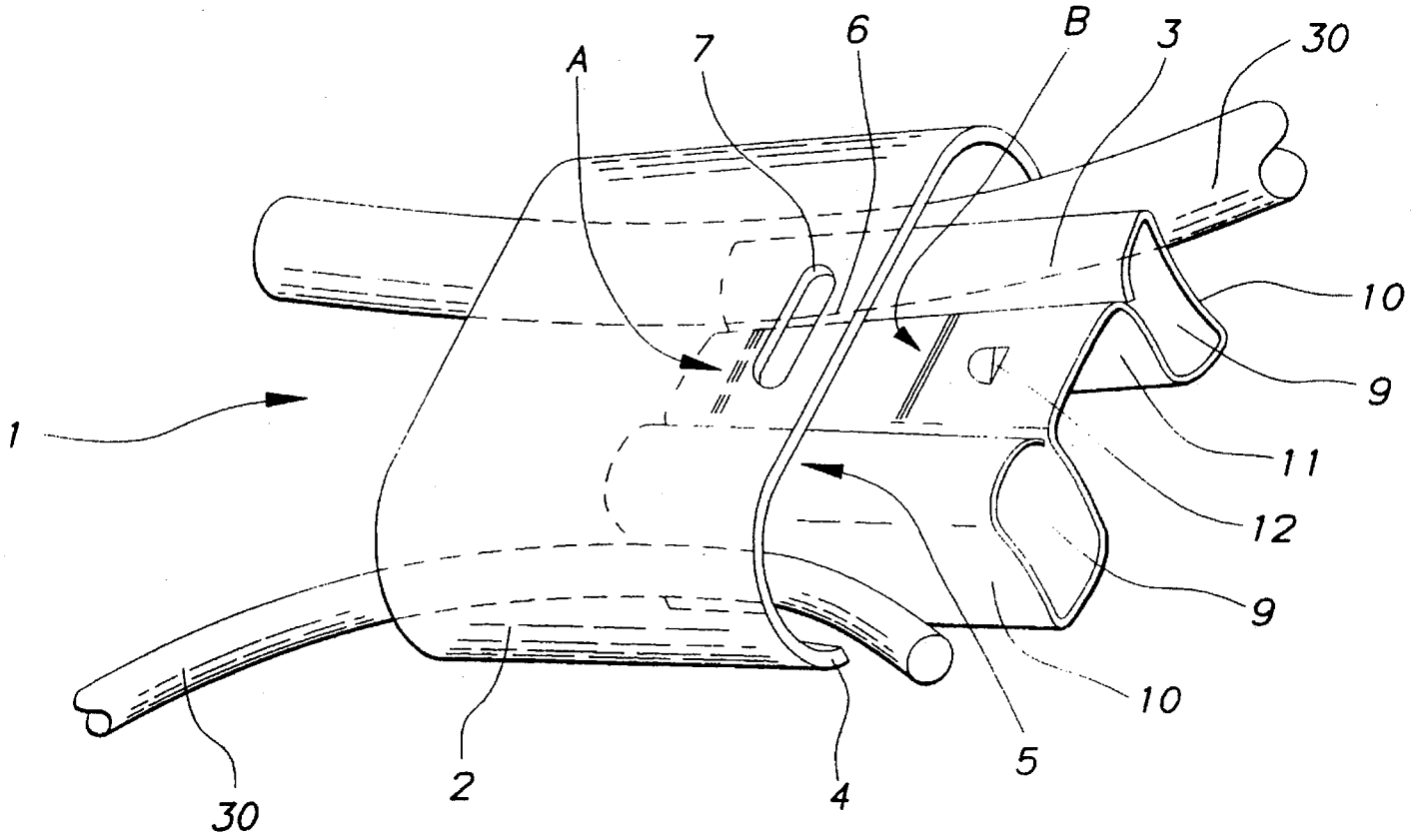
FIG. 2 is a perspective view of the bottom part of the connector assembly which also shows the wedge type element being inserted in the C shaped element.
Figure 3:
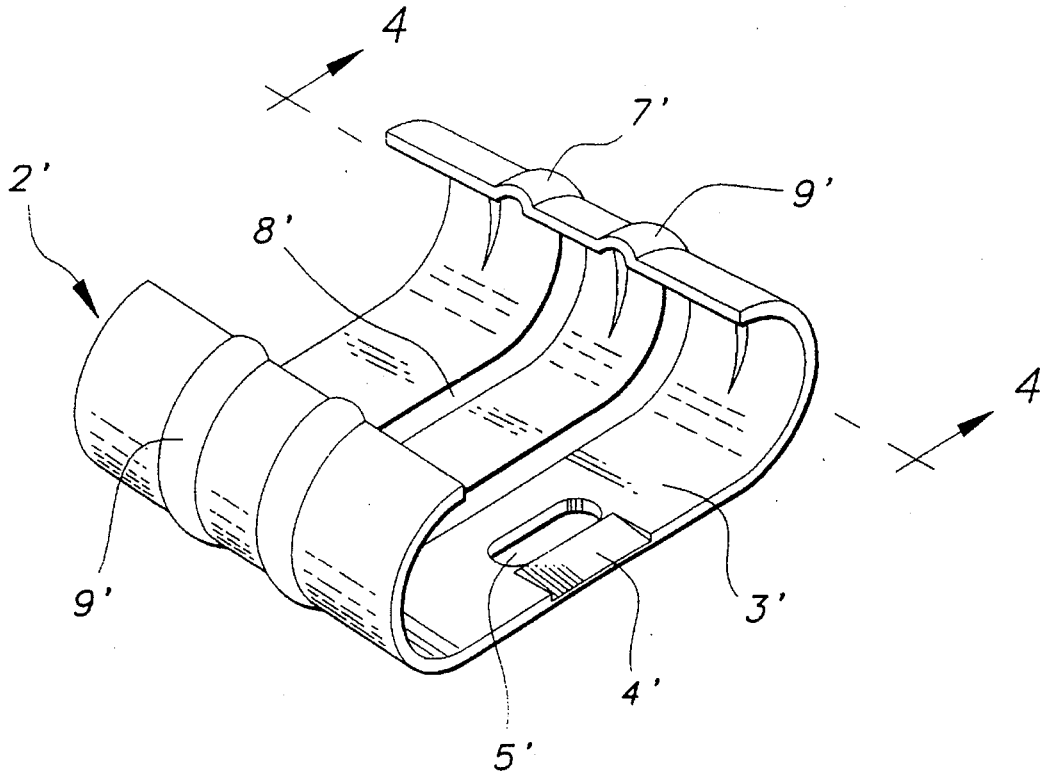
FIG. 3 is a perspective view showing the C-shaped member of the connector.
Figure 4:
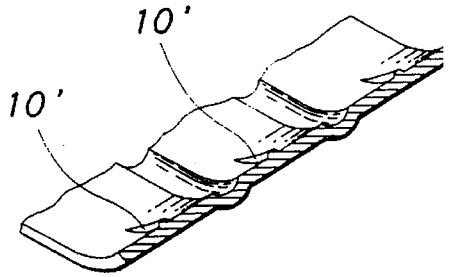
FIG. 4 is a perspective view showing a sectioned portion of the C-shaped member FIG. 3 taken along line 4—4 of FIG. 3.
Figure 5:
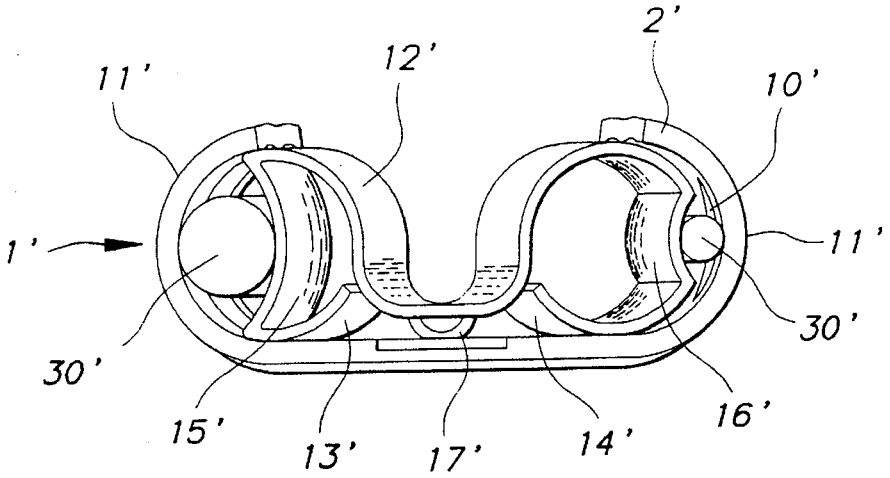
FIG. 5 is a frontal perspective view showing the present invention in an assembled state.
Figure 6:
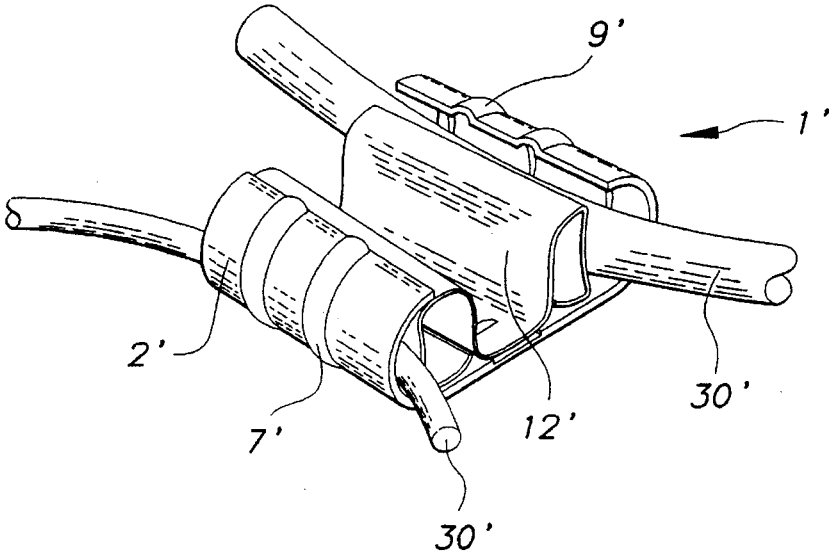
FIG. 6 is a perspective view of the assembled connector, showing the cables arranged in the connector assembly.

Referring to FIGS. 1–2, one can determine the connector assembly 1 comprised of a first C-shaped outer element 2 and a second wedge type inner element 3.

The first and second outer element 2 and inner element 3 are obtained by folding sheet metal. The first element 2 is generally C-shaped, the loose ends being turned to fit the cables 30, and the inner lower part 5 being provided with a slope 6 adjacent to an orifice 7.

The second element 3 is wedge shaped due to the inward folding of the sheet metal which forms cylindrical parts 9 having outer lateral ducts 10 which will secure the cables 30 together with the inner part of the beaded flanges 4 of the C-shaped element 2.

A central duct 11 is formed during the folding of the wedge type element 3, at the rear part of same, said central duct 11 having a ridge 12 which fits into orifice 7 of C-shaped element 2 to clamp the cables 30 in the connector assembly.

With the wedge type connectors a great variety of combinations of conductor cable are made possible, being limited solely to the sum of the minimum and maximum conductor combinations, varying in accordance with a specific cable diameter for each type of conductor.

The present invention has the purpose of providing an alternative arrangement to the known connectors, which will permit the technician to determine which is the correct type of connector for an as yet unknown arrangement in conductor cables, without damaging the connectors (as it will not be necessary to assemble them beforehand).

It is possible to determine the type of connector without previously assembling the connectors by the incorporation of marks, preferably two already predetermined ones, in the C-shaped element 2, in the wedge type element 3, or in both of them.

The marks may be made in the first and second elements of the connectors during their manufacture or later, and they may be superficial marks such as obtained by painting, center punching, or any other means.

As is shown in FIGS. 1 and 2, the position of mark A indicates the limit of acceptance of the connector in accordance with the maximum sum of combinations of the cable diameters. The position of mark "B" indicates the limit of acceptance of the minimum sum of the combination of cables.

With marks A and B it is possible for the technician to check, before applying the connector, whether the type of connector chosen is correct, without risk of utilizing an unsuitable connector.

As a practical example it may be cited that, as seen from FIG. 1, the fact that the frontal part of the wedge is situated between marks A and B indicates that the sum of the diameters of the conductor cables is within the specific maximum and minimum limits for this type of connector. Marks A and B are foreseen on both free edges 4 of the first C-shaped element 2.

As mentioned previously, marks A and B may alternatively be made in the second wedge type element 3 (see FIG. 2) for the purpose of aiding the installer to visualize the assembly of the connector when seen from the other side of same.

In a second embodiment, as shown in FIG. 2, the rear part of the C-shaped element 2 is placed between marks A and B, which indicates that the sum of the diameters of the conductor cables is within a specific minimum and maximum limit for the chosen connector.

Another embodiment of the present invention is shown in FIGS. 3–6, Connector 1' comprises two pieces which fit together to secure conductor cables 30' between them. One of the pieces is a member 2' of generally C-form which is stamped and formed from a sheet, usually from sheet metal, which is bent in the shape of a "C". In the bottom portion 3' is provided a ramp 4' adjacent to an opening 5'.

Receptacle 2' has at least two radially arranged recesses 7' forming inwardly directed channels 8 and outwardly directed protuberances 9'.

The inner portion of receptacle 2' is provided with a plurality of holding teeth 10' which are longitudinally spaced apart along the length of the receptacle 2'.

The holding teeth 10' are preferably provided, in the inner side wall 11' of receptacle 2', in the concave portion of the same, are in the shape of notches, which shape is suitable to increase the tensile strength of the cables in the connector. In the embodiment of the present invention, the notches have a diamond shape. It should be noted that the diamond shape is an illustrative shape and not a restrictive one.

Teeth 10' can be arranged in a way to be inserted between the two recesses 7' in order to provide a greater tensile strength to the receptacle 2' to better distribute the tension of the connection along the cables and to permit an increase of the tensile value of the cables in the connector assembly.

The other piece of the connector assembly 1' is a wedge-shaped member 12' comprised of a sheet material, preferably of sheet metal which is folded inwardly forming two cylindrical portions 13' and 14' having channels 15' and 16' respectively, which will secure and tense up cables 30' against the wall 11' of receptacle 2'.

Usually, the receptacle 2 of the connector 1' is placed in cables 30' and the wedge member 12' is inserted into the receptacle to secure cables 30'. The wedge member 12' is provided of a locking nub 17' which slides on the ramp 4' fitting in opening 5', thus preventing the unlocking of the wedge member 12' from receptacle 2'.

It should be understood that the inventions described herein are not limited to the shown and described embodiments thereof; rather, various other changes may be made therein without departing from the scope of the appended claims.

Accordingly, what is claimed is:

1. An electrical connector having a generally C-shaped member for electrically connecting wires with a wedge member, the electrical connector comprises:

radially arranged recesses and holding teeth formed on said C-shaped member, said teeth provide increased friction for retaining the wires, and said recesses comprise means for stiffening said C-shaped member and thereby increasing the frictional retention of said wires by said teeth.

2. The electrical connector of claim 1, wherein the radially arranged recesses generally extend completely across the C-shaped member.

3. The electrical connector of claim 1, wherein the C-shaped member is made of stamped and formed sheet metal.

4. The electrical connector of claim 1, wherein the holding teeth are disposed between the radially arranged recesses for engagement with the wires.

5. The electrical connector of claim 1, wherein at least two indicia marks are provided on either of the C-shaped member or the wedge member.

6. An electrical connector having a generally C-shaped member for electrically connecting wires with a wedge member, the electrical connector comprises:

at least two indicia marks formed on either of the C-shaped member or the wedge member for indicating the sum of the diameters of the conductor cables to an operator.

7. The connector of claim 6, wherein the indicia marks comprise lines on said connector.

* * * * *